United States Patent [19]

Pearce, Jr. et al.

[11] 4,240,917

[45] Dec. 23, 1980

[54] TRANSFORMER USING CATALYTICALLY HYDROGENATED BRIGHT STOCK FLUID

[75] Inventors: Henry A. Pearce, Jr., Stoneboro; Edward J. Walsh, Hermitage, both of Pa.

[73] Assignee: Westinghouse Electric Corp., Pittsburgh, Pa.

[21] Appl. No.: 27,639

[22] Filed: Apr. 6, 1979

[51] Int. Cl.[3] ..... H01B 3/22

[52] U.S. Cl. ..... 336/94; 208/14; 208/18; 585/6.6

[58] Field of Search ..... 252/63; 208/14, 18; 336/94

[56] References Cited

U.S. PATENT DOCUMENTS

| | | | |
|---|---|---|---|
| 3,011,972 | 12/1961 | Watson et al. | 208/38 X |
| 3,419,497 | 12/1968 | Rocchini et al. | 252/63 |
| 3,549,537 | 12/1970 | Brewster et al. | 252/63 |
| 3,732,154 | 5/1973 | Mills et al. | 208/87 |
| 3,759,817 | 9/1973 | Mills et al. | 208/14 |
| 3,932,267 | 1/1976 | Lewis et al. | 252/63 X |
| 4,069,166 | 1/1978 | Masunaga et al. | 252/63 |
| 4,082,866 | 4/1978 | Unk | 427/294 |

FOREIGN PATENT DOCUMENTS 186604 5/1966 U.S.S.R. .

*Primary Examiner*—Harris A. Pitlick
*Attorney, Agent, or Firm*—R. D. Fuerle

[57] ABSTRACT

A transformer is disclosed which comprises a tank comprising a laminated magnetic core and a winding immersed in a fluid which comprises bright stock catalytically hydrogenated to an aromaticity of 5 to 30 percent. This fluid provides inexpensive insulation for transformers without the need for additives to obtain acceptable physical and electrical properties.

6 Claims, 1 Drawing Figure

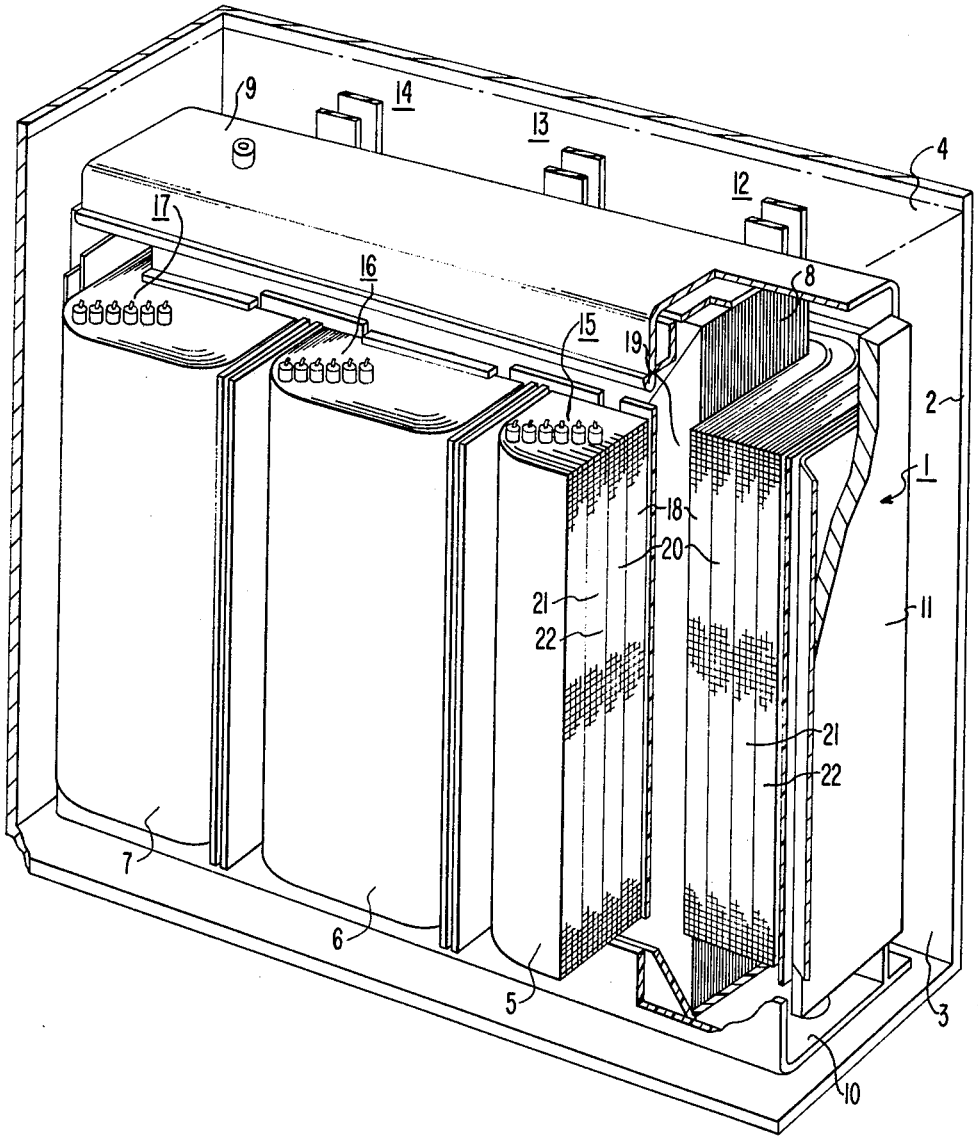
9
14
13
12
4
17
16
8
15
19
2
1
18
20
21
22
11
21
22
7
6
5
3
10

TRANSFORMER USING CATALYTICALLY HYDROGENATED BRIGHT STOCK FLUID

BACKGROUND OF THE INVENTION

At the present time polychlorinated biphenyls, formerly widely used in transformers and capacitors, are no longer being produced or used in the United States due to environmental concerns. They have been replaced with silicone fluids and with hydrocarbon fluids such as a fluid described in U.S. Pat. No. 4,082,866 a mixture of naphthenic hydrocarbons and hydrogenated paraffins. Both of these fluids meet NEC code requirements for fire resistance with a 300° fire point and no propagation of the flame, and both fluids are environmentally acceptable. However, these fluids, especially the silicone fluids, are quite expensive.

SUMMARY OF THE INVENTION

We have discovered that bright stock which has been catalytically hydrogenated to an aromatic carbon content of 5 to 30 percent is an inexpensive transformer fluid which meets NEC code requirements for fire resistance and has acceptable physical and electrical properties. The fluid of this invention can be used without the addition of additives, thus reducing the cost of preparation and the possibility that an additive will be an environmental pollutant. Because the fluid of this invention is 5 to 30 percent aromatic, it absorbs flammable decomposition gases, such as hydrogen, carbon monoxide, and methane, much more readily than do fully-saturated fluids, thereby reducing the chance of fire or explosion. The aromatic content of the fluid of this invention also increases the oxidation stability of the fluid compared to fully-saturated hydrocarbon fluids. Finally, the fluid of this invention is less viscous than the fluid of U.S. Pat. No. 4,082,866 and therefore has better heat transfer.

PRIOR ART

U.S. Pat. No. 4,082,866 describes a fully-saturated hydrocarbon oil. U.S. Pat. Nos. 3,732,154 and 3,759,817 describe the catalytic hydrogenation of low molecular weight distillates to produce transformer oils.

DESCRIPTION OF THE INVENTION

The accompanying drawing is a view of a three-phase power transformer constructed according to the teachings of this invention with parts broken away for clarity. In the drawing, a transformer 1 is mounted within a tank 2 which is filled with a fluid 3, hereinafter described, to level 4. The transformer includes phase windings 5, 6, and 7 which are disposed on the legs of a laminated magnetic core 8. The winding and core assembly is rigidly held in position by the top support 9, the bottom support 10, and side braces such as the brace 11. Each of the phase windings 5, 6, and 7 has a low voltage winding with the low voltage lead pairs 12, 13, and 14 attached thereto, respectively. High voltage lead groups 15, 16, and 17 are connected to the high voltage windings of the phase windings 5, 6, and 7, respectively. A low voltage winding 18 is disposed in close proximity to the leg 19 of magnetic core 8. High voltage winding sections 20, 21, and 22 are disposed concentrically around the low voltage winding 18. The lead group 15 provides means for connecting the voltage windings 20, 21, and 22 to a tap changing mechanism or to a terminal board arrangement so that the leads may be connected differently, in relation to each other, to provide different high voltage winding ratings. The low voltage winding 18 is positioned nearest to the magnetic core 8. The high voltage winding 20 is adjacent the low voltage winding 18. The high voltage winding section 22 forms the outermost winding of the phase winding 5 and the winding section 21 is disposed between the high voltage winding sections 20 and 22.

The fluid used in the transformer of this invention is prepared from aromatic bright stock, a lubricating oil of high viscosity, obtained from residues of petroleum distillation by dewaxing and treatment with fuller's earth or similar material. The bright stock is hydrogenated until its aromaticity is reduced to 5 to 30 percent. That is, 5 to 30 percent of its carbon atoms are aromatic. If it is less than 5 percent aromatic, it lacks oxidation stability and has poor gas absorption. If it is more than 30 percent aromatic, it is too flammable and its pour point is too high. Preferably, it is 5 to 15 percent aromatic. Hydrogenation of the bright stock is accomplished by passing the bright stock through a tower at high temperatures which contain hydrogen and catalysts. This is a known process which is described in U.S. Pat. Nos. 3,732,154 and 3,759,817.

It is preferable that the fluid contain no additives because they add to the expense of preparing the fluid, and they may cause environmental problems. However, if desired up to 0.3 percent by weight of an oxidation stabilizer and up to 2 percent by weight of a pour point depressant may be added. More than 0.3 percent of an oxidation stabilizer has no additional effect on stability. Di-t-butyl-p-cresol or di-t-butyl phenol may be used as an oxidation stabilizer.

The viscosity of the fluid used in this invention is generally less than the fluid of U.S. Pat. No. 4,082,866. At 25° C. it has a viscosity of about 250 to 300 centistokes. The fluid must not contain water, corrosive sulfur, or inorganic chlorides as these substances reduce its electrical properties. However, the presence of these substances is usually not a problem because they are removed during the catalytic hydrogenation which is necessary to prepare the fluid used in this invention.

The following examples further illustrate this invention:

EXAMPLE 1

In this example a catalytically hydrogenated bright stock which was 8.7 percent aromatic was used. The fluid had a viscosity of 293 centistokes at 25° C. A neutralization number of 0.0005 milligrams KOH per milligram of fluid, and interfacial tension (IFT) of 57.1 dynes per centimeter, a fire point of 582° F., moisture content of less than 20 ppm, a dielectric strength of 42 kv according to ASTM test D877, and contained 0.05 or 0.1 percent di-t-butyl-p-cresol. The fluids were subjected to rotary bomb ASTM test D2112 to measure oxidation stability. The fluid containing 0.05 percent inhibitor required 315 minutes to consume a given amount of oxygen according to the test, and the fluid containing 0.1 percent inhibitor required 370 minutes to consume the given amount of oxygen according to the test.

EXAMPLE 2

A catalytically hydrogenated bright stock was used which was similar to that used in Example 1 except that it was 5.2 percent aromatic, had a dielectric strength of 43 kv according to ASTM test D877, a viscosity at 40° C. of 118 centistokes, and a fire point of 585° F. Two liter samples of the fluid were placed in stainless steel tanks with samples of insulation and conductors normally found in transformers, and the samples were heated at 125° and 150° C. for up to ninety days. The following table gives the result and compares the fluid to mineral oils used in transformers:

| Fluid | Condition | Acid No. | IFT | Dielectric Strength | Moisture After Aging (ppm) | Power Factor After Aging |
|---|---|---|---|---|---|---|
| Bright Stock | Cloudy | 0.04 | 42.5 | 32 | 7 | 0.01 |
| Mineral Oil (Westinghouse "Wemco C") | Clear | 0.21 | 31.9 | 30 | 25 | 0.21 |
| Bright Stock | Clear | 0.02 | 47.9 | 33 | 35 | 0.001 |

EXAMPLE 3

A catalytically hydrogenated bright stock similar to Example 1 except that it was 11 percent aromatic and was tested for oxidation stability.

| General Condition | Clear |
|---|---|
| Dielectric Strength - (kv) | 17-27-28 |
| Power Factor Percent (60 Hertz 25° C.) | 0.003 |
| Interfacial Tension (Dynes per cm.) | 55.7 |
| Neutralization No. (mg KOH per gram) | 0.006 |
| Kinematic Viscosity (Centistokes 40° C.) | 115.52 |
| Specific Gravity (6° F.) | 0.858 |
| Pour Point (°F.) | +5 |
| Moisture (ppm) | 17 |
| Fire Point | 305° C. |
| Results of ASTM Test 2440 After 72 Hours % | 0.008 |

EXAMPLE 4

This experiment was performed on a catalytically hydrogenated bright stock having 5.2 percent aromatic.

| General Condition | Clear |
|---|---|
| Dielectric Strength (kv 25° C.) | 43-41 |

-continued

| General Condition | Clear |
|---|---|
| Power Factor Percent (60 Hertz 25° C.) | 0.0001 |
| Interfacial Tension (Dynes per cm) | 57.1 |
| Neutralization No. (mg KOH per gram) | 0.0005 |
| Kinematic Viscosity (Centistokes 40° C.) | 117.56 |
| Specific Gravity (6° F.) | 0.872 |
| Pour Point (°F.) | −0 |
| Moisture (ppm) | 17 |
| Results of ASTM Test D2115 (minutes) | 41 |
| Results of ASTM Test D2112 - Using 0.15% Di-t-butyl-p-cresol (minutes) | 390+ |

We claim:

1. A transformer comprising a tank containing a magnetic core and a winding immersed in a fluid which comprises bright stock catalytically hydrogenated to an aromaticity of 5 to 30 percent.

2. A transformer according to claim 1 wherein said fluid includes up to about 0.1 percent of an oxidation stabilizer and up to about 2 percent of a pour point depressant.

3. A transformer according to claim 2 wherein said oxidation stabilizer is di-t-buytl-p-cresol or di-t-butyl phenol.

4. A transformer according to claim 1 wherein said bright stock is hydrogenated to an aromaticity of 5 to 15 percent.

5. A transformer comprising a tank containing a laminated magnetic core and a winding immersed in a fluid which consists essentially of bright stock hydrogenated to an aromaticity of 5 to 30 percent.

6. A transformer according to claim 5 wherein said bright stock is hydrogenated to an aromaticity of 5 to 15 percent.

* * * * *